United States Patent [19]

Esformes et al.

[11] Patent Number: 4,984,626

[45] Date of Patent: Jan. 15, 1991

[54] EMBOSSED VORTEX GENERATOR ENHANCED PLATE FIN

[75] Inventors: Jack L. Esformes; Lawrence W. Ubowski, both of Syracuse, N.Y.

[73] Assignee: Carrier Corporation, Syracuse, N.Y.

[21] Appl. No.: 441,026

[22] Filed: Nov. 24, 1989

[51] Int. Cl.[5] ..... F28D 1/04; F28F 1/26

[52] U.S. Cl. ..... 165/151; 165/181

[58] Field of Search ..... 165/151, 181, 182

[56] References Cited

U.S. PATENT DOCUMENTS

| | | | |
|---|---|---|---|
| 1,416,570 | 5/1922 | Modine | 165/151 |
| 1,453,250 | 4/1923 | Schnoeckel | 165/151 |
| 1,557,467 | 10/1925 | Modine | 165/151 |
| 1,575,864 | 3/1926 | Owston | 165/151 |
| 1,927,325 | 9/1933 | Ritter | 165/151 |
| 1,971,842 | 8/1934 | Young | 165/151 |
| 2,217,469 | 10/1940 | Clarke | 165/181 |
| 4,279,298 | 7/1981 | Lee | 165/181 |

FOREIGN PATENT DOCUMENTS

| | | | |
|---|---|---|---|
| 0075190 | 6/1980 | Japan | 165/181 |
| 2088544 | 6/1982 | United Kingdom | 165/151 |

*Primary Examiner*—John Rivell
*Assistant Examiner*—L. R. Leo
*Attorney, Agent, or Firm*—Robert H. Kelly

[57] ABSTRACT

An enhanced plate fin of a plate fin heat exchanger wherein vortex generator enhancements are embossed above and below the surface of the plate fin for the purpose of oversizing the boundary layer fluid between adjacent fins.

5 Claims, 3 Drawing Sheets

EMBOSSED VORTEX GENERATOR ENHANCED PLATE FIN

BACKGROUND OF THE INVENTION

The present invention relates generally to heat exchangers, and more particularly to finned tube heat exchanger coils having sine-wave like plate fins including embossed vortex generating enhancements.

Plate fins utilized in the air conditioning and refrigeration industry are normally manufactured by progressively enhancing a coil of plate fin stock by a shearing operation whereby open enhancements are formed on the surface of the fin stock. After the open enhancements are formed, the fin stock is cut to the desired length. The fins are then collected in the proper orientation and number in preparation for forming a coil. Previously formed hairpin tubes are then inserted through openings within the fins and thereafter expanded to form mechanical and thermal connections between the tubes and fins. The open ends of the hairpin tubes are fluidly connected by way of U-shaped return bends, and subsequently the return bends are soldered or brazed in place.

The plate fins are typically manufactured in a die with forming, punching or shearing pins to form the fin shape, the open surface enhancements on the fin, and the openings through which tubular members are inserted.

It is known that a fundamental contributor to the limiting of local convective heat transfer is the establishment and persistence of thermal boundary layers on the plate fin surfaces of heat exchangers. For this reason, prior art fins are provided with a variety of surface variations or enhancements to disrupt the boundary layer and to improve the transfer of heat energy between the fluid passing through the tubular members and the fluid passing over the plate fin surfaces. These prior art enhanced fins are generally either enhanced flat fins or convoluted fins. Flat fins and convoluted fins are generally enhanced by punching or shearing raised lances, louvers, or ramp and delta wings therein. A raised lance is defined as an elongated portion of fin formed by two parallel slits whereby the material between the parallel slits is raised or displaced from the mid-plane of the fin. A louver is defined as an elongated portion of fin formed by one or two parallel slits whereby the material adjacent to a singular slit, or between parallel slits, is rotated about the mid-plane of the fin to a prescribed angle. A ramp or delta wing is defined as a portion of a fin having one side length connected to the fin in a direction generally perpendicular to the direction of fluid flow over the wing while the remaining sides are slit and raised from the surface of the fin. Typical of the previous plate fin heat exchangers utilizing enhancements are U.S. Pat. Nos. 4,860,822 and 4,787,442 assigned to the assignee herein. These lances and wings promote thinning of the hydrodynamic boundary layer and serve to generate secondary flows which increase the heat transfer coefficient. However, generally large numbers of lances and louvers and wings are added to a surface to improve the heat transfer, but these enhancements are always accompanied by an increase in pressure drop through the coil.

Further, such lanced, louvered, and raised winged plate fins may be difficult and costly to manufacture, due to the complex manufacturing problems associated with numerous, small punching stations which are necessary to shear the fin stock to make the enhancements. Still further, the shearing operation results in waste material in the form of scrap fragments which can render the forming die inoperable.

Thus, there is a clear need for a sine-wave like plate fin having an embossed enhanced surface which reduces waste material while improving the heat energy dissipation and increasing the reliability of the forming dies.

SUMMARY OF THE INVENTION

It is an object of the present invention to improve the transfer of heat from an enhanced fin in a plate fin heat exchanger coil by providing an embossed enhancement.

It is another object of the present invention to provide an enhanced plate fin having a sine-wave like pattern in cross-section with embossed enhancements at or downstream of the peaks (maximum) and troughs (minimums) of the sine-wave to decrease the boundary layer thickening or separation by generating vortices of the size order of the boundary layer and to direct the vortices into the boundary layer to energize the boundary layer fluid.

It is yet another object of the present invention to minimize viscous losses of the fluid flowing between two adjacent wavy fins having staggered rows of vortex generating embossments by reducing or eliminating recirculation at the peaks and troughs.

It is a further object of the present invention to provide an enhanced wavy fin with embossed vortex generators formed in rows alternately above and below the surface of the fin which does not remove heat transfer surface and this preserves the heat conduction paths throughout the fin.

It is still a further object of the present invention to provide an embossed wavy fin which decreases the air film thermal resistance of the wavy fin while not unduly increasing air-side pressure drop.

These and other objects of the present invention are obtained by means of an enhanced plate fin having a sine-wave like pattern in cross-section having rows of embossed vortex generators at the peaks and troughs of the sin-wave or at a predetermined distance downstream of the peaks and troughs along their longitudinal length. The embossed vortex generators are generally of a height in the range between $\frac{1}{4}$ and $\frac{1}{2}$ of the distance between adjacent fins in a coil to prevent boundary layer thickening and separation, since the vortices generated by those embossed elements are of the same proportion as the embossments themselves. Further, the rows of vortex generators are alternately embossed on opposite surfaces of the fin to decrease the thermal resistance between adjacent fins.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

Other objects and advantages of the present invention will be apparent from the following detailed description in conjunction with the accompanying drawings, forming a part of this specification and which reference numerals shown in the drawings designate like or corresponding parts throughout the same, and in which.

DESCRIPTION OF THE PREFERRED EMBODIMENT

The embodiments of the invention described herein are adapted for use in condensing or evaporating heat exchangers used in heating, ventilating, and air conditioning systems, although it is to be understood that the invention finds like applicability in other forms of heat exchangers. Plate fin heat exchangers are generally used in conventional direct expansion vapor compression refrigeration systems. In such a system, the compressor compresses gaseous refrigerant, often R-22, which is then circulated through a condenser where it is cooled and liquefied and then through an expanding control device to the low pressure side of the system where it is evaporated in another heat exchanger as it absorbs heat from the fluid to be cooled and changes phase from a partial liquid and partial vapor to a superheated vapor. The superheated vapor then flows the compressor to complete the cycle.

Typically, a plate fin heat exchanger is assembled by stacking a plurality of parallel fins, and inserting a plurality of hair pin tubes through the fins and mechanically expanding the tubes to make physical contact with each fin. The heat transfer characteristics of the heat exchanger are largely determined by the heat transfer characteristics of the individual plate fins.

Figure 1:
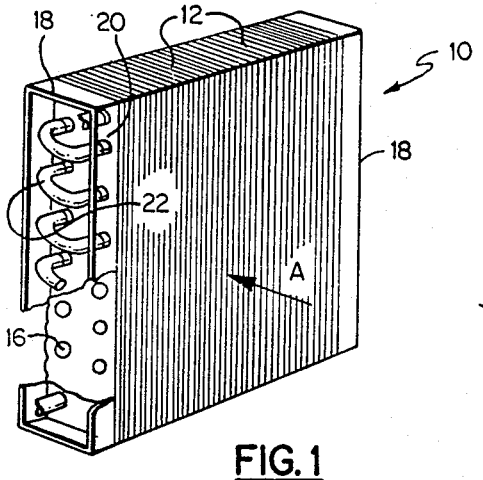
FIG. 1 is a perspective view of a plate fin heat exchanger incorporating the enhanced plate fin of the present invention.

Referring now to the drawings, FIG. 1 illustrates a fin tube heat exchanger coil 10 incorporating a preferred embodiment of the present invention. Heat exchanger coil 10 comprises a plurality of spaced-apart fin plates 12, wherein each plate fin 12 has a plurality of holes 16 therein. Fin plates 12 may be any heat conductive material, e.g. aluminum. Fin plates 12 are maintained together by oppositely disposed tube sheets 18 having holes therethrough in axially alignment with holes 16. A plurality of hair pin tubes 20 are laced through selected pairs of holes 16 as illustrated and have their open ends joined together in fluid communication by return bends 22, which are secured to hair pin tubes 20 by soldering or brazing or the like. The hair pin may be any heat conductive material, for example, copper.

In operation, a first fluid to be cooled or heated flows through hair pin tubes 20 and a cooling or heating fluid is then passed between fin sheets 12 and over tubes 20 in a direction indicated by arrow A. Heat energy is transferred from or to the first fluid through hair pin tubes 20 and plate fins 12 to or from the other fluid. The fluids may be different types, for example, the fluid flowing through tubes 20 can be refrigerant and the cooling fluid flowing between plate fins 12 and over the tubes 20 can be air.

As illustrated in FIG. 1, finned tube heat exchanger coil 10 is a staggered two-row coil since each plate fin 12 has two rows of staggered holes therein for receiving hair pin tubes 20. The present invention contemplates a heat exchanger coil of one or more rows of tubes and with holes 16 of one row in either staggered or in-line relation with the holes 16 of an adjacent row. Also, the heat exchanger can be a single row heat exchanger of a composite heat exchanger made from a plurality heat of single row heat exchangers.

Referring now to FIGS. 2–7, a portion of the multi-row plate fin 12 is illustrated having staggered rows of tube holes 16 with enhanced heat transfer sections 24 between respective adjacent pairs of holes 16. A fluid, in the direction of arrow A, flows across the multi-row plate fin. Collars 14 are formed about holes 16 during fin manufacture for receiving tubes 20 therein and for properly spacing adjacent plate fins. In FIGS. 2–7 only the plate fin 12 is shown and the tubes that would normally pass through the collars 14 are omitted for simplicity.

Figure 2:
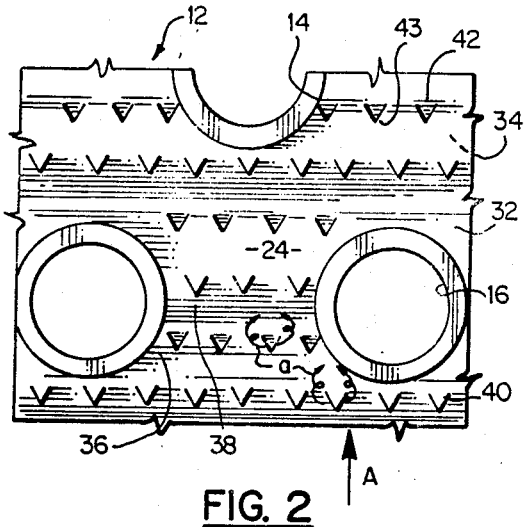
FIG. 2 is a partial plan view of a multi-row plate fin according to a preferred embodiment of the invention.
Figure 3:
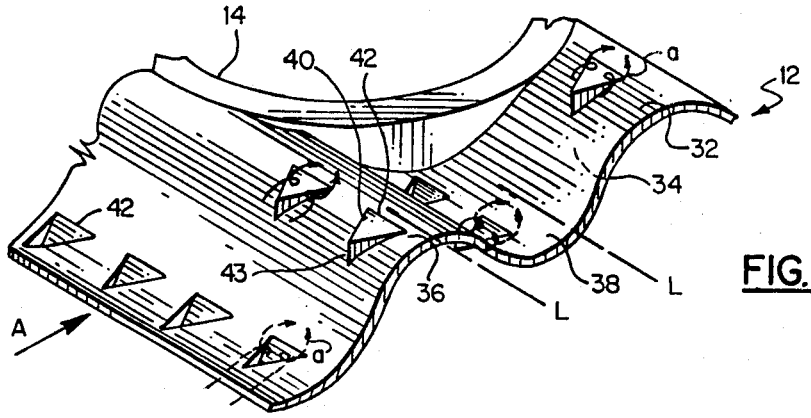
FIG. 3 is an enlarged partially broken away perspective view of the multi-row plate fin of FIG. 2.
Figure 4:
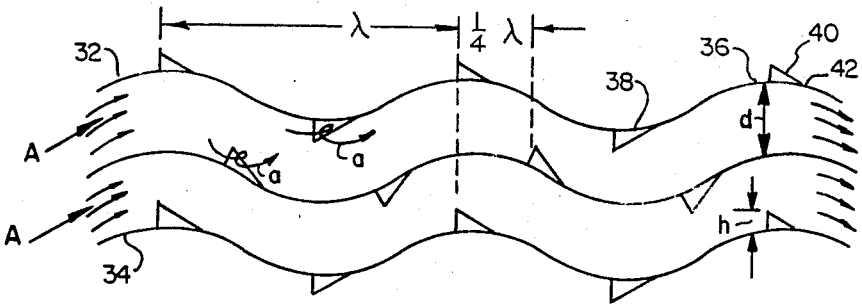
FIG. 4 is a transverse cross-sectional view of a portion of a heat exchanger with the preferred embodiment of FIG. 2.
Figure 6:
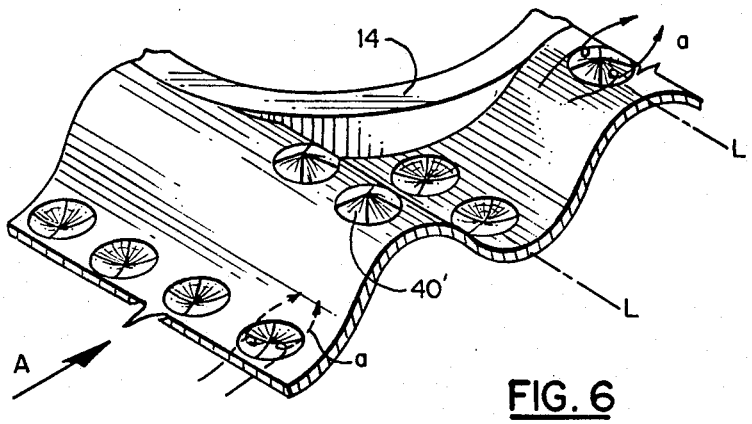
FIG. 6 is an enlarged partially broken away perspective view of the preferred embodiment of FIG. 5.
Figure 5:
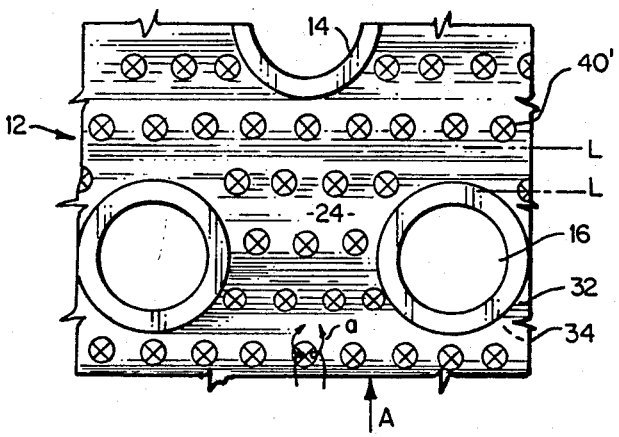
FIG. 5 is a partial plan view of a multi-row plate fin according to another preferred embodiment of the present invention.
Figure 7:
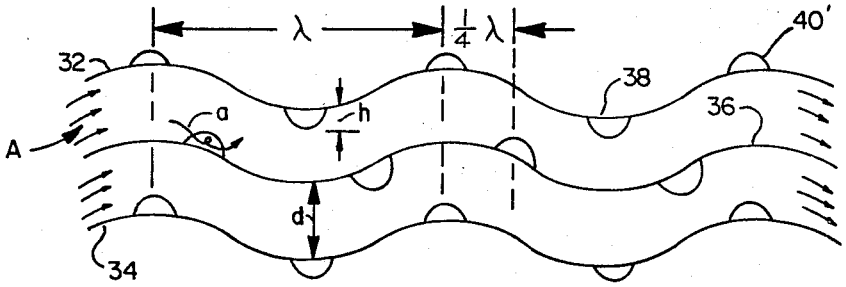
FIG. 7 is a transverse cross-sectional view of a portion of a heat exchanger with the preferred embodiment of FIG. 5.

In FIGS. 2–7, the plate fin 12 has a fluid flowing over the top side or upper surface 32 and over the bottom side or lower surface 34. The fluid flows over both of these surfaces in the same direction. The triangular shaped embossments 40, as shown in FIGS. 2–4, and the circular or dome shaped embossments 40', as shown in FIGS. 5–7, are formed in rows in a direction perpendicular to the flow "A". The embossments 40 and 40' in adjacent rows are moved alternately away from the top surface 32 then the bottom surface 34 and generate counter rotating vortices as shown by arrows "a". The right hand vortice rotating counter clockwise and the left hand vortice (viewed in the direction of flow) rotating clockwise as more clearly shown in FIGS. 3 and 5. Still further, as shown in FIGS. 4 and 7 the triangular shaped embossments 40 and circular shaped embossments 40' are generally embossed in the plate fin in the range between $0\lambda$ and $\frac{1}{2}\lambda$ downstream in the flow direction of the longitudinal center-line (shown as line L) of the peaks 36 and troughs 38 thus generating vortices on both the upper and lower surfaces to energize the boundary layer fluid. One complete length of sine-wave like pattern is defined as Lambda ($\lambda$). The off-center position of the embossed wings 40 downstream of the longitudinal center line (L) of the peaks 36 and troughs 38 is generally equal to the point of maximum pressure difference about the fin surface. The embossed wings 40, shown in FIGS. 2–4 as triangular shapes with their base portion 42 downstream of the flow and their apex 43 upstream of the flow—and shown as circular vortex generating shapes 40' in FIGS. 5–7—generate vortices (a) which travel downstream and energize the stalled boundary layer in the downstream peaks or troughs on both the upper 32 and lower 34 surfaces.

Since the vortices that are generated by the embossments 40 and 40' have been found to be of the same proportions as the embossments themselves and since efficiency can be increased by energizing the boundary layer fluid it is desirable to generate vortices of the same size order as the boundary layer and to direct them into the boundary layer. Thus as shown in FIGS. 4 and 7, where the distance between adjacent fins is "d", the range of the height ("h") of the embossments 40 and 40' is in the preferred range between ¼d and ½d.

Figure 8:
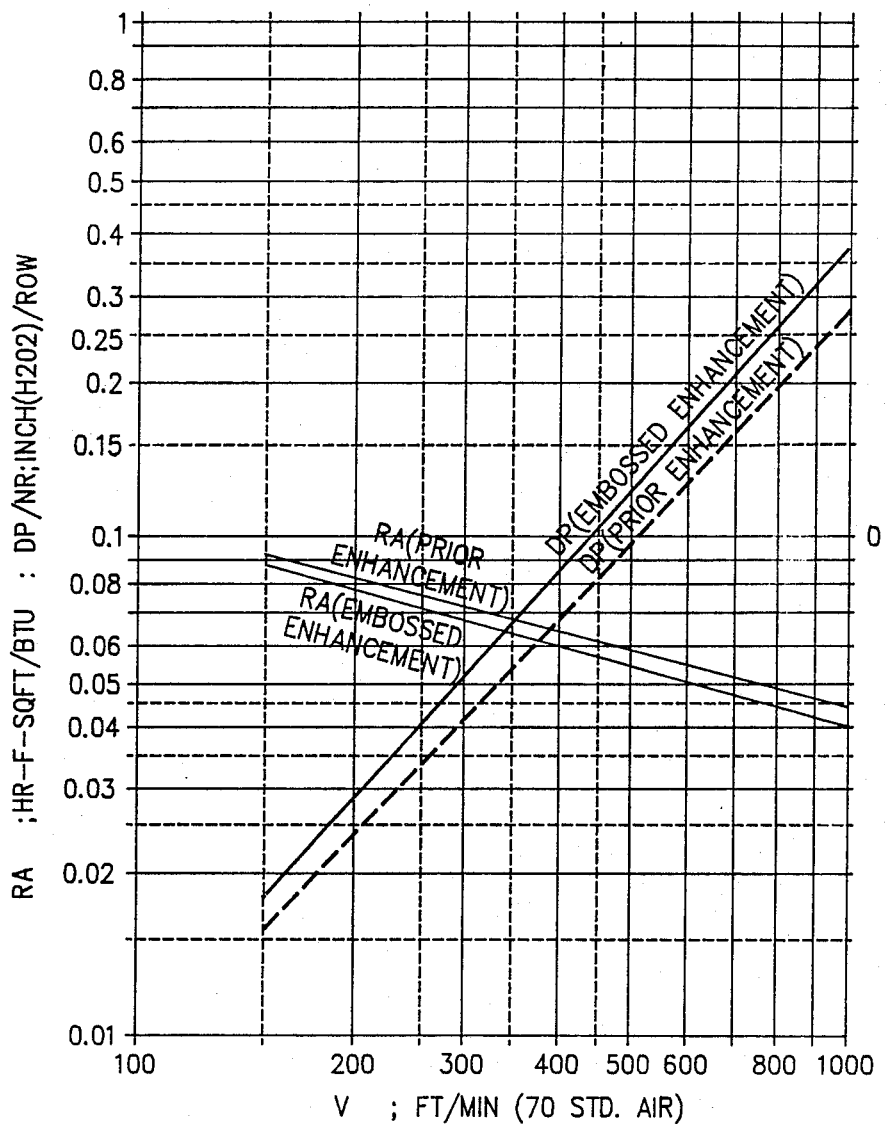
FIG. 8 is a diagram which compares the dry performance of the preferred embodiment of FIG. 5 with a prior art wavy-fin enhanced fin.

FIG. 8 is a diagram showing the dry performance relationship between the circular embossment 40' and a split wavy-fin enhanced fin of the prior art, wherein the thermal resistance (RA) (HR-F-SQ. FT./BTU) and the pressure drop per tube rows (DP/NR) (inches of water/row) are given as an ordinate and the air velocity (V) (FT./MIN-70° F. standard air) is given as an abscissa. Generally, enhancements on a fin will improve the thermal performance of the fin, but will also increase the pressure drop across the fin. However, if the increase in pressure drop is generally less than two (2) times the increase in thermal performance, the system efficiency or cost effectiveness can be greatly improved. As apparent from FIG. 8, the increase in pressure drop due to the embossment of the present invention, is less than two (2) times the increase in thermal performance. A summary of the results at 300 feet per minute air-face velocity is as follows:

| | Prior Enhancement | Embossed Enhancement |
|---|---|---|
| Thermal performance | 1.00 | 1.10 |
| Pressure Drop (relative) | 1.00 | 1.18 |

While the preferred embodiments of the present invention have been depicted and described, it will be appreciate by those skilled in the art that many modifications, substitutions, and changes may be made thereto without the departing from the true spirit and scope of the invention.

What is claimed is:

1. In an enhanced plate fin of a plate fin heat exchanger having a plurality of enhanced plate fins each having a convoluted heat transfer means for enhancing the exchange of heat between a fluid flowing over a surface of the fin, the convoluted heat transfer means having a sine-like wave pattern of predetermined height along the fin in a direction parallel to the flow of fluid over the fin, the sine-like wave pattern having curved peaks at a maximum and minimum of the wave heights of the pattern along the fin, the peaks extend along the convoluted heat transfer means generally transverse to the direction of flow of the fluid flowing over the fin, the improvement comprising an enhanced heat transfer section, said enhanced heat transfer section having a plurality of spaced apart rows of enhancement means arranged in a direction generally perpendicular to the direction of flow of the fluid over the fin, each spaced apart row of enhancement means comprising a series of generally identical embossed vortex generator means, each spaced apart row of enhancement means being located downstream in the fluid direction of the maximum and minimum of the curved peaks in the range between 0 and ¼λ, where one complete length of the sine-wave like pattern is equal to one λ, said embossed vortex generator means forming a continuous fin surface on said enhanced heat transfer section free from apertures therethrough wherein each embossed vortex generator means generates a pair of counter rotating vortices.

2. An enhanced plate fin as set forth in claim 1 wherein the ratio between a height of said embossed vortex generator means from the surface of the fin and the distance between adjacent fins in the plate fin heat exchanger is in the range between 0.25 and 0.50.

3. A plate fin as set forth in claim 2 wherein said embossed vortex generator means is triangular shaped with an apex of said triangular shape upstream in the direction of flow and a base portion downstream in the direction of flow of the fluid flowing over the fin.

4. A plate fin as set forth in claim 2 wherein said embossed vortex generator means is circular-dome shaped.

5. A plate fin as set forth in claim 2 wherein adjacent rows of said embossed vortex generator means are raised alternately upwardly and downwardly from the surface of the fin.

* * * * *